US005222578A

United States Patent [19]

Thorp

[11] Patent Number: 5,222,578

[45] Date of Patent: Jun. 29, 1993

[54] SAFETY BRAKE

[75] Inventor: James T. Thorp, Edwardsville, Ill.

[73] Assignee: U.S.A. Hoist Corporation, Crest Hill, Ill.

[21] Appl. No.: 920,619

[22] Filed: Jul. 24, 1992

[51] Int. Cl.[5] ..... B66B 11/04

[52] U.S. Cl. ..... 187/19; 187/89; 188/184

[58] Field of Search ..... 187/19, 89, 90, 91, 187/73; 188/187, 188, 189, 184, 71.1, 71.4

[56] References Cited

U.S. PATENT DOCUMENTS 3,415,343 12/1968 Svensson ..... 187/19
3,866,717 2/1975 Johansson ..... 187/19
4,531,617 7/1985 Martin et al. ..... 187/89

*Primary Examiner*—Robert P. Olszewski

*Assistant Examiner*—Kenneth Noland

*Attorney, Agent, or Firm*—Dressler, Goldsmith, Shore, Sutker & Milnamow Ltd.

[57] ABSTRACT

A safety brake of the type for use in hoist. As a hoist cage descends or ascends faster than a predetermined safety speed, a corresponding high speed motion is transmitted to a main shaft of the safety brake through a input pinion gear connected to the main shaft for engagement with a vertical rack attached to a hoist tower. Movable braking disks are attached to the main shaft for rotation therewith. Fixed braking disks are interleaved with the movable disks. Such high speed motion causes a dog retained in the main shaft to centrifugally move outwardly to engage the drum. The actuator assembly connected to the drum acts to cause the drum to move against the fixed and movable braking disks.

6 Claims, 3 Drawing Sheets

SAFETY BRAKE

TECHNICAL FIELD

The present invention relates to a safety brake for a hoist which is designed to effect a stop of a cage or platform movable along a hoisting tower when the descending or ascending speed of the cage exceeds a predetermined speed.

BACKGROUND OF THE INVENTION

Hoists have been widely used to hoist workmen and materials on building construction work sites. A typical hoist includes a hoisting tower constructed of lattices of steel angle iron, and a lift cage or platform equipped to be vertically movable along the hoisting tower. The lift cage is guided by rollers along a vertical path provided in the hoisting tower and is driven by motors having pinions engaging with vertical racks attached to the tower along the vertical path.

In such a rack and pinion drive system, there are usually provided safety brakes to stop a cage when it exceeds a predetermined speed. A particular safety brake generally has an input pinion gear in engagement with the rack. In the event that the input gear rotates faster than a predetermined rate, the safety brake starts to operate stopping its input gear to provide a braking force to the cage.

U.S. Pat. No. 4,258,832, to Thorp, discloses a safety brake in which a centrifugal control assembly is connected to an input pinion gear engaging a vertical rack of a hoist, and a dog of the control assembly is positioned inside a drum of a brake assembly. When the dog is thrown outwardly by centrifugal force, it engages an internal tooth of the drum and simultaneously a tab of an actuator so that the drum and the actuator are both operatively connected to the input pinion gear for rotation. Movable braking disks are attached to the drum for rotation therewith. The movable braking disks are interleaved with the fixed braking disks which are non-rotatably but slidably fixed to a housing of the safety brake. The actuator rotates a ball screw and a nut of the ball screw moves axially to compress slidably fixed braking disks against the rotating braking disks to effect a braking force until the cage is stopped.

Although this patent apparatus presented an advance in the art, it was not without any drawbacks. Since the movable disks are attached to the drum, they do not rotate until the drum is operatively connected to the main shaft. Those movable disks are therefore required to be lubricated. Such lubrication disadvantageously acts to reduce friction between the movable and fixed disks when compressed to each other, which friction produces a braking force.

The present invention provides a further advancement in the art, as will be fully explained below.

SUMMARY OF THE INVENTION

A safety brake embodying the principles of the present invention is the type which is connected to a hoist cage movable along a hoist tower and has an input pinion gear in engagement with a vertical rack attached to the hoist tower for stopping the hoist cage immediately after the hoist cage exceeds a predetermined speed and accordingly the pinion gear rotates faster than a predetermined rate.

The safety brake in accordance with the present invention includes an main shaft rotatably supported in a housing. The main shaft has one end connected to the input pinion gear and another end portion having at least one angular cutout portion circumferentially thereof. Movable braking disks are operatively connected to said main shaft for rotation therewith. Fixed braking disks are interleaved with the movable braking disks and are slidably fixed in the housing.

The safety brake further includes a drum coaxially aligned with the main shaft. The drum has at least one internal tooth and a stop surface urgedly positioned at least in an axial proximity of the fixed braking disks. Preferably the top surface is urgedly placed in a light contact with the fixed braking disks.

The cutout portion of the main shaft retains a dog for its rocking action. The dog is configured to be centrifugally rocked or moved outwardly to engage the internal tooth of the drum as the main shaft rotates faster than the predetermined rate. An actuator assembly is connected to the drum. The actuator assembly acts to axially push the drum in response to the engagement of the drum with the dog so that the top surface of the drum compresses the fixed braking disks against the movable braking disks to effect a braking.

In the illustrated embodiments, the actuator assembly includes external threads provided on an outer surface of a rod portion connected to and axially extending from the bottom wall of the drum. The external threads engage internal threads of a nut which also has external threads in engagement with internal threads of a splined nut. The splined nut has a surface urgedly brought in contact with the bottom wall of the drum. In response to the engagement of the drum and the dog, the splined nut axially moves to cause the drum to move against the fixed and movable braking disks to effect the braking.

The illustrated splined nut is slidably fitted within a splined cap which is urgedly retained in the housing for rotation and sliding motion. The reset operation can be readily performed by pushing in and rotating the splined cap to cause the drum to return to its original position.

Other features and advantages of the present invention will become readily apparent from the following detailed description, the accompanying drawings, and the appended claims.

DETAILED DESCRIPTION

Figure 1:
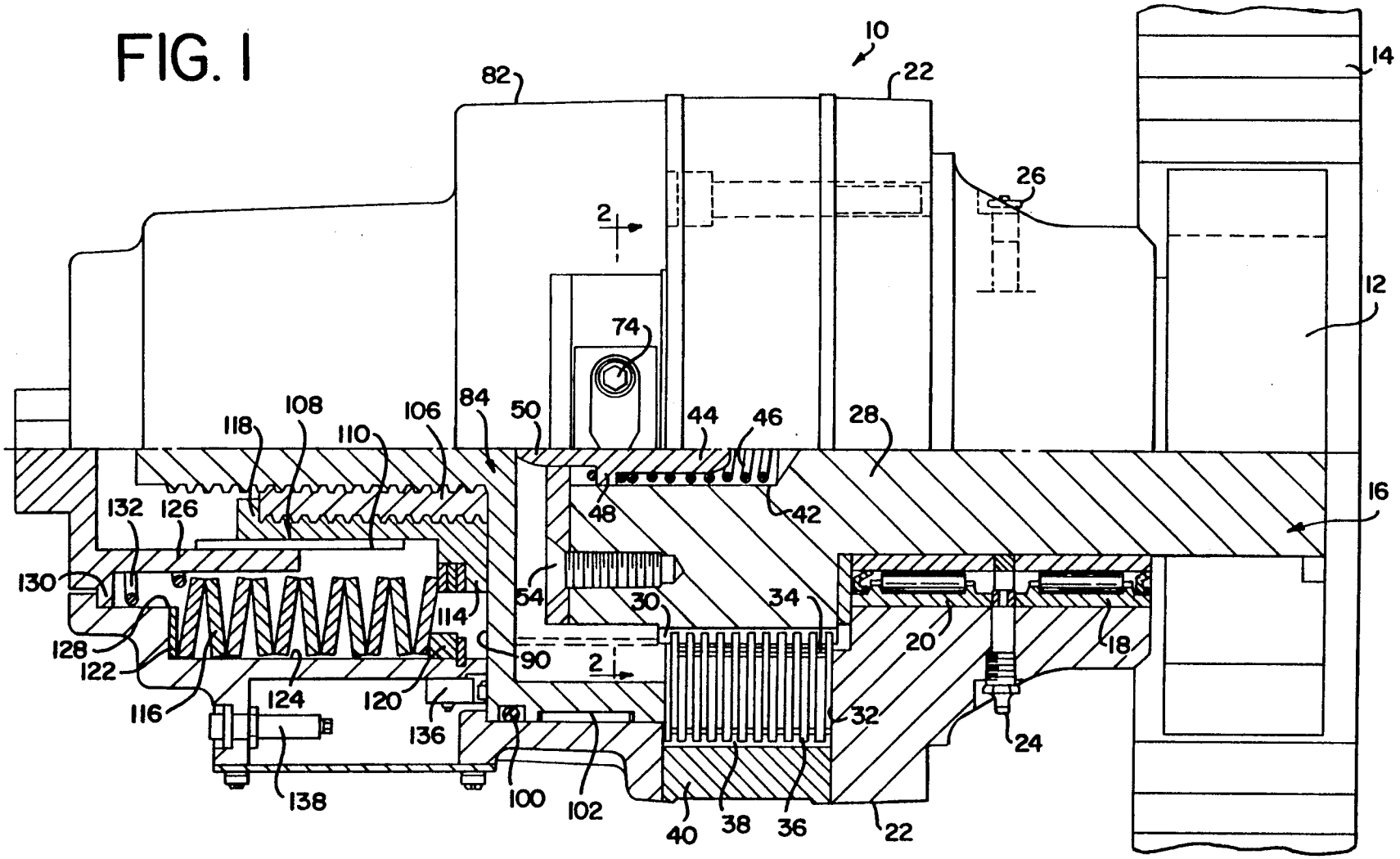
FIG. 1 is a side elevational view of the safety brake of the present invention, including a lower half portion in cut away cross-section.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring now to the drawings, FIG. 1 shows one embodiment of a safety brake 10 is fixed to a lift cage which is attached for vertical movement to a hoisting tower. The safety brake 10 has an input pinion gear 12 to engage with a vertical rack 14 attached to the hoisting tower along the vertical path so that when the lift cage descends at a higher rate, for example, the pinion gear 14 rotates faster accordingly.

The pinion gear 12 is fixed to a distal end of a main shaft 16 which has adjacent the distal end an intermediate portion rotatably supported by two pairs of roller bearings 18, 20 disposed in a front housing 22 of the safety brake 10. A lower grease fitting 24 and an upper relief fitting 26 are disposed axially between the two pairs of roller bearings 18, 20. The main shaft 16 extending from the roller bearings 18, 20 radially expands to define an opposite or inner end portion 28 which has a diameter greater than that of the intermediate portion. The inner end portion 28 has adjacent the intermediate portion a plurality of equally spaced external slots 30 for receiving respective internal tabs of steel braking disks 32 so that the steel braking disks 32 are always operatively connected to the main shaft 16 for rotation therewith. Wave washers 34 are mounted to forcibly space the individual steel braking disks 32 apart from each other. The steel braking disks 32 are interleaved with bronze braking disks 36. The bronze braking disks 36 have external tabs extending into slots 38 provided within an inside wall of an annular cup 40 of the front housing 22 so that they are not rotatable but are slidably movable in an axial direction to compress the steel braking disks 32. The inner end portion 28 of the main shaft 16 includes a center bore 42 which extends outwardly from an inner end surface of an along a center axis of the main shaft 16 to receive thrust means comprising a thruster 44 and a thruster spring 46. The thruster 44 has an annular collar 48 which is slidably received within the center bore 42 and is urged inwardly by the thruster spring 46. The thruster 44 also has a tip portion 50 extending through an opening of a stop plate 52 which is fixed by screws 54 to the inner end portion 28 of the main shaft 16 so that the thruster 44 is retained and permitted to axially move within the center bore 42.

Figure 2:
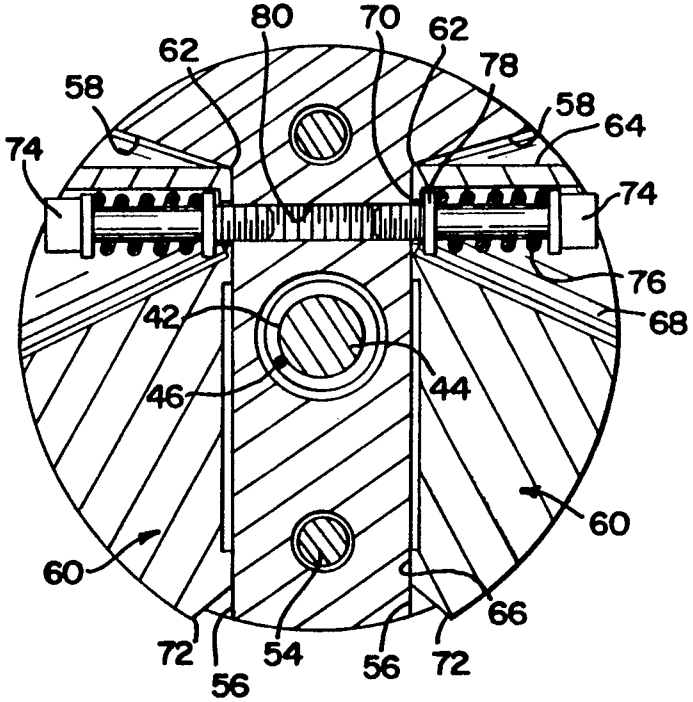
FIG. 2 is a cross-sectional view taken along line 2—2 of FIG. 1.

As illustrated in FIG. 2, the inner end portion 28 of the main shaft 16 has adjacent its external slots 30 along its circumference at least one, preferably two angular cutout portions positioned symmetrically with respect to a plane intersecting the center axis of the main shaft 16 to define a stepped head portion in the inner end portion 28 of the main shaft 16, the cutout angle defined between straight sides 56, 58 of each angular cutout portion being slightly greater than a right angle. A dog 60 is movably retained in each of the angular cutout portions for swing or rocking action about its heel 62. The dog 60 includes an abutment surface 64 and a resting surface 66 which coincide at the heel 62 to define a corner angle smaller than the cutout angle so that its rocking action about the heel is accommodated within the cutout angle of the angular cutout portion. The dog 60 further includes an inwardly-converging tapered cavity 68 which terminates at an opening 70, and a toe 72. A cap screw 74 within the tapered cavity 68 extends through a spiral spring 76, washer 78 and the opening 70 to be screwed into a threaded bore 80 extending through the stepped head portion of the inner end portion 28 so that the compressed spring 76 pushes washer 78 against the dog 60 to movably retain dog 60 in place. The force or compressed length of the spring 76 for retaining dog 60 is adjusted by turning the cap screw 74.

Figure 3:
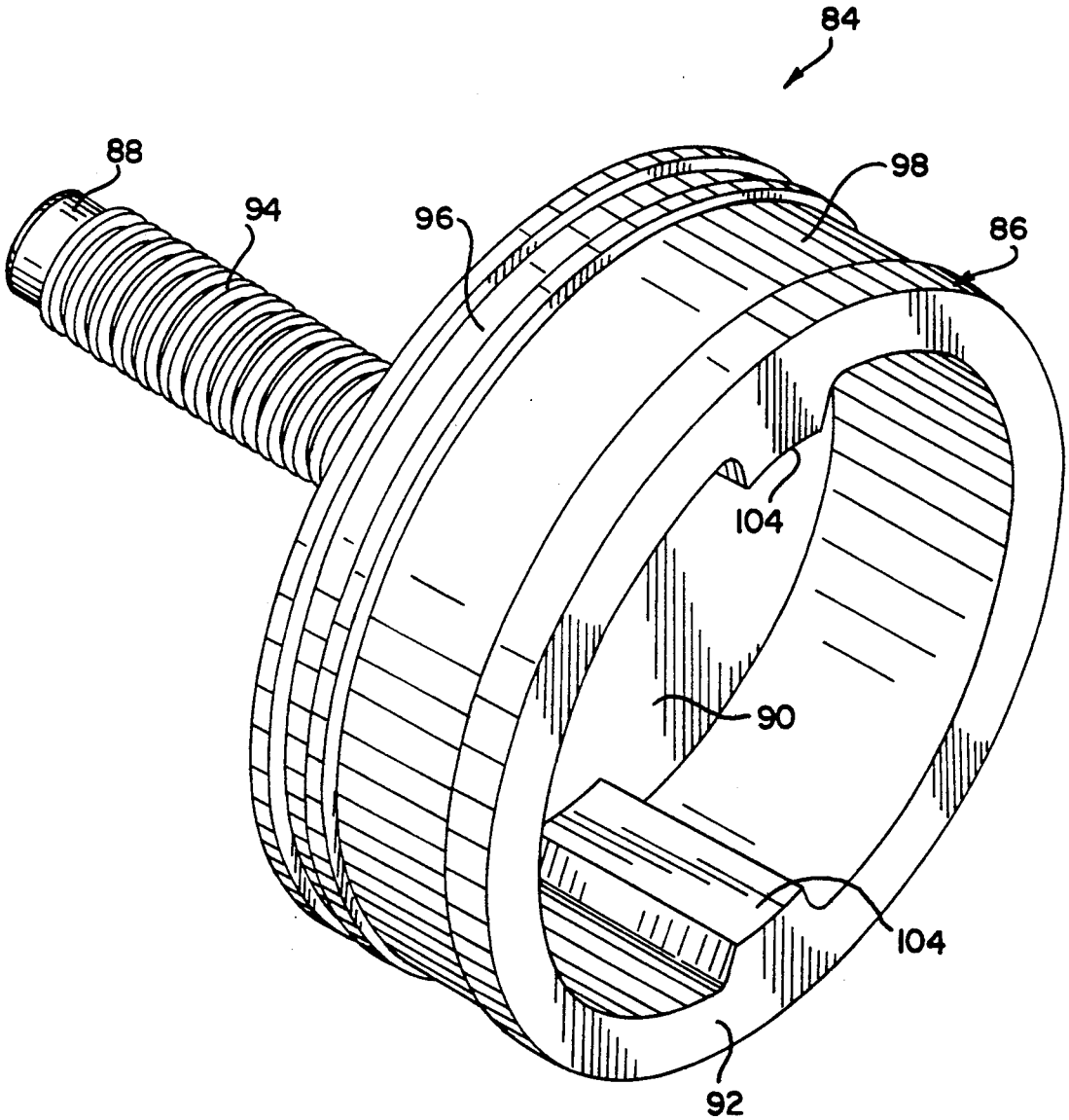
FIG. 3 is a perspective view of the drum.

A rear housing 82 connected to the front housing 22 within its inside wall supports a drum 84 for rotation about a substantially coaxis with the center axis of the main shaft 16. As best seen in FIG. 3, the drum 84 comprises a drum portion 86 and a rod portion 88 connected to a bottom wall 90 of the drum portion 86. The drum portion 86 has a cylindrical side wall within which the inner end portion 28 of the main shaft 16 is inserted so that a top surface 92 of the cylindrical side wall of the drum portion 86 positions in the proximity of an inner face of the innermost bronze braking disk 36 and the tip portion 50 of the thruster 44 pushes against the bottom wall 90 of the drum portion 86. The rod portion 88 has a threaded outer surface 94. The drum portion 86 has at its cylindrical side wall circumferentially extending external annular grooves 96, 98 to receive a O-ring 100 and a Teflon bearing 102. The cylindrical side wall has two internal teeth 104 radially facing toward each other.

The drum is connected to an actuator assembly which in response to the engagement of the dog 60 with the drum 84 acts to axially push the drum 84 so that the top surface of the drum 84 compresses the fixed braking disks 36 against the movable braking disks 32 to effect a braking. Specifically, the actuator assembly includes the external threads 94 of the rod portion 88 which engages with internal opposite threads of a bronze nut 106. The bronze nut 106 is also provided with external threads to engage with internal threads of a splined nut 108 which includes a plurality of external splines 110 to slidably fit within a cylinder portion of a splined 112 to urgeably retained in the rear housing 82 for rotational and sliding movement. The splined nut 108 has at its one end an external flange portion 114 which is axially urged by compressible means, such as a stack of Belleville washers 116, toward the bottom wall 90 of the drum portion 86 of the drum 84 so that its end surface is urgeably brought in contact against the bottom wall of the drum. The splined nut 108 also has its another end an internal flange 118 to receive one end of the bronze nut 106 which has another end facing toward the bottom wall 90 of the drum 84. The Belleville washers 116 are retained by two ring stoppers 120, 122 between a first annular wall 124 of the rear housing 82 and a cylindrical side wall 126 of the splined cap 112. The one end of the Belleville washers 116 is designed to abut against the external flange portion 114 of the splined nut 108 in a normal condition. The other end of the Belleville washers 116 abuts against the stopper ring 122 fitted to a step which connects the first annular wall 124 to a second annular wall 128 of the rear housing 82. The splined cap 112 has an external annular collar 130 which is slidably received within the second annular wall 128 of the rear housing 82 and is pressed by a spring 132 to abut against an internal flange portion 134 extending from the second annular wall 128 of the rear housing 82. A switch 136, such as a contact switch, is provided on an outer surface of the first annular wall 124 in the rear housing 82 to contact the bottom wall 90 of the drum 84. An indicator lamp 138 is electrically connected to the contact switch 136 so that it turns on once the contact switch 136 gets out of contact with the bottom wall 90 of the drum 84.

In a normal operation where the regulator controls the motor to raise or lower the cage within the predetermined maximum speed, the pinion gear 12 rotates with the steel braking disks 32. The thruster 44 is axially urged by the thruster spring 46 so that the tip portion 50 thereof substantially axially presses a center point of the bottom wall 90 of the coaxial drum 84.

In the event that the regulator should fail to regulate the motor and the cage begins to ascend or descend at an excessive rate, the rotational speed of the pinion gear 12 exceeds a desired maximum rate. As soon as the main shaft 16 connected to the pinion gear 12 starts to rotate at the exceeding rate, the dogs 60 are centrifugally moved outwardly and one of the dogs 60 is brought in engagement with one of the inner teeth 104 of the drum 84 as illustrated in FIG. 4.

Figure 4:
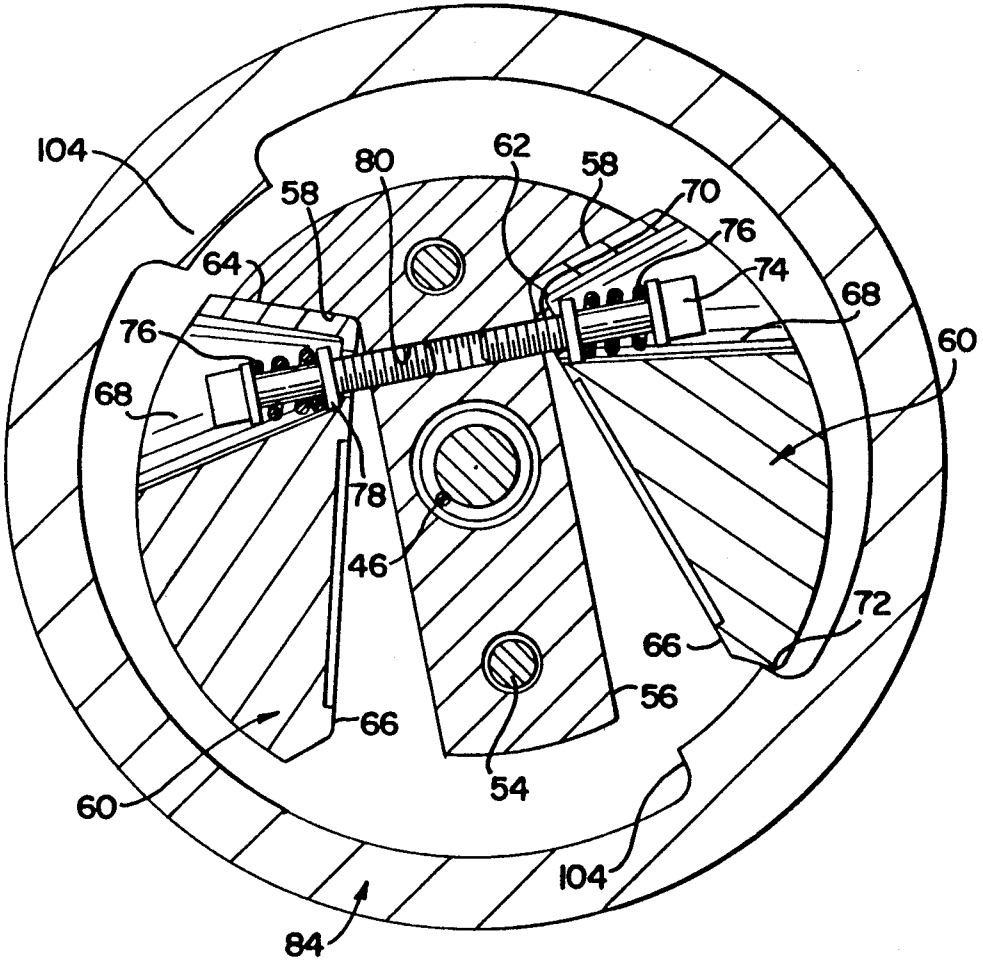
FIG. 4 is a cross-sectional view illustrating that the dogs in their resting positions in FIG. 2 are centrifugally moved outwardly and one of the dogs engages one of the internal teeth of the drum.

With reference to FIG. 4, the centrifugal force causes each dog 60 to rock about its heel 62 against the force exerted by the spring 76 until its abutment surface 64 thereof abut against the straight side 58 of the angular cutout portion. Specifically, one dog 60 rocks about its heel 62 in a clockwise direction and another doge 60 rocks about is heel 62 in a counter clockwise direction. As appreciated, it is designed that either one of the dogs 60 is engageable with one of the internal teeth 104 of the drum 84 whichever direction the main shaft 16 may rotate as the hoist cage ascends or descends. The inwardly-converging tapered cavity 68 is configured to accommodate the angular movement of the cap screw 74. When the toe 72 of the dog 60 engages the internal tooth 104 of the drum 84, the dog 60 is locked between the internal tooth 104 and the straight side 58 of the angular cutout portion and the drum 84 simultaneously begins to rotate with the main shaft 16.

The drum 84 rotates the bronze nut 106 through their threading engagement. Since the splined nut 108 in engagement with the bronze nut 106 is prevented from rotation by its splined connection to the splined cap 112, the splined nut 108 is caused to axially slide to cause the drum to move against the fixed and movable braking disks 32, 36 to effect a braking force. Since the main shaft 16 is operatively connected to the steel braking disks 32 for rotation therewith, such an increasing braking force is applied to the main shaft 16 until the cage is stopped.

When the drum 84 moves axially outwardly to depart from the contact with the switch 136 as the braking is being applied, the switch 136 is actuated to generate and sends a signal to a controller (not shown) which controls a relay for interrupting the power to the driving motor of the cage. The switch 136 also sends a signal to the indicator lamp 138 which is turned on responsive to the signal to inform the user of the need to reset or restore the safety brake to a normal use position.

A reset operation is readily performed by pushing in and sliding the splined cap 112 outwardly along the splines 110 and the second annular wall 128, and then rotating the splined cap 112 so as cause the drum 84 to return to its original position. The dog 60 is then returned to its normal resting position by the compression force of the spring 76.

The movable braking disks runs dry at all times since they always rotate with the main shaft and wave washers aid to decrease friction between the fixed and movable braking disks by spacing them apart. This eliminates the necessity of lubricating the braking disks so that the compression of those dry braking disks produces a quick braking force.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover by the appended claims all such modifications as fall within the scope of the claims.

What is claimed is:

1. A safety brake connected to a hoist cage movable along a hoist tower that has an input pinion gear in engagement with a vertical rack attached to the hoist tower for effecting a braking to stop the hoist cage immediately after the hoist cage exceeds a predetermined speed and accordingly the pinion gear rotates faster than a predetermined rate, said safety brake comprising:

a main shaft rotatably supported in a housing and having one end portion connected to said input pinion gear and another end portion having at least one angular cutout portion circumferentially thereof;

movable braking disks operatively connected to said main shaft for rotation therewith;

fixed braking disks interleaved with said movable braking disks and slidably fixed in said housing;

a drum coaxially aligned with said main shaft and having a drum portion, said drum portion having at least one internal tooth and a top surface urgedly positioned at least in an axial proximity of said fixed braking disks;

a dog movably retained in said cutout portion of the main shaft for rocking action, said dog being configured to be centrifugally rocked outwardly to engage said internal tooth of the drum as said main shaft rotates faster than said predetermined rate; and an actuator assembly connected to said drum for acting to axially push said drum in response to said engagement thereof with said dog so that the top surface of the drum compresses said fixed braking disks against said movable braking disks to effect said braking.

2. A safety brake in accordance with claim 1, wherein said actuator assembly comprises external threads provided on an outer surface of a rod portion axially extending from said bottom wall of the drum portion of said drum, a nut having internal threads in engagement with said external threads of said rod portion and external threads in engagement with internal threads of a splined nut, said splined nut having a surface urgeably brought in contact against said bottom wall of said drum and configured to be non-rotatable but axially slidable so that in response to said engagement of said dog with said drum said splined nut axially moves to cause the drum to move against the fixed and movable braking disks.

3. A safety brake in accordance with claim 2, wherein said splined nut is slidably fitted within a splined cap, said splined cap being urgeably retained in said housing for rotational and sliding movements so that said drum is returned to its original position by pushing in and rotating said splined cap.

4. A safety brake in accordance with claim 1, wherein said angular cutout portion of the main shaft has an angular defined between straight sides and said dog includes an abutment surface and a resting surface which coincide at a heel to define a corner angle smaller than said cutout angle, said resting surface being pressed against one of said straight sides of said angular cutout portion by urging means so that said dog is retained within said angular cutout portion for rocking action about said heel.

5. A safety brake in accordance with claim 4, wherein said dog includes an inwardly-converging tapered cavity which terminates at an opening and said urging means comprises a screw positioned within said tapered cavity for extending through a spring, a washer and said opening to be screwed into a threaded bore provided in said another end of the main shaft so that said spring is adjustably compressed by said screw to urge said resting surface of said dog against said straight side of said angular cutout portion of said main shaft.

6. A safety brake in accordance with claim 1, wherein said another end portion of the main shaft includes two angular cutout portions arranged symmetrically with respect to a plane intersecting a center axis of said main shaft and each angular cutout portion retains said dog for rocking action such that one dog is centrifugally rocked in a clockwise direction and another dog in a counter-clockwise direction so that either one of said dogs is engageable with one of said internal teeth of the drum whichever directions said main shaft rotates.

* * * * *